US011378241B1

(12) United States Patent
De Best et al.

(10) Patent No.: US 11,378,241 B1
(45) Date of Patent: Jul. 5, 2022

(54) ILLUMINATION DEVICE, LIGHTING SYSTEM AND METHOD OF OPERATING THE ILLUMINATION DEVICE

(71) Applicant: SIGNIFY HOLDING B.V., Eindhoven (NL)

(72) Inventors: Anna Wilhelmina Marie De Best, Veldhoven (NL); Joris Jan Vrehen, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/603,046

(22) PCT Filed: Apr. 16, 2020

(86) PCT No.: PCT/EP2020/060650

§ 371 (c)(1),
(2) Date: Oct. 12, 2021

(87) PCT Pub. No.: WO2020/212464

PCT Pub. Date: Oct. 22, 2020

(30) Foreign Application Priority Data

Apr. 18, 2019 (EP) ..... 19170049

(51) Int. Cl.
*F21S 10/06* (2006.01)
*F21V 23/00* (2015.01)
(Continued)

(52) U.S. Cl.
CPC ..... *F21S 10/06* (2013.01); *F21V 23/003* (2013.01); *F21Y 2113/10* (2016.08); *F21Y 2115/10* (2016.08)

(58) Field of Classification Search
CPC ..... F21S 10/06; F21V 23/003; F21Y 2113/10; F21Y 2115/10
See application file for complete search history.

(56) References Cited

U.S. PATENT DOCUMENTS 8,820,963 B2 * 9/2014 Olsen ..... F21V 5/002 362/249.02
2013/0039090 A1 * 2/2013 Dau ..... F21V 7/0033 362/217.05

(Continued)

FOREIGN PATENT DOCUMENTS

GB 2473311 A 3/2011
JP 2011222182 A 11/2011

(Continued)

*Primary Examiner* — Evan P Dzierzynski
(74) *Attorney, Agent, or Firm* — Daniel J. Piotrowski

(57) ABSTRACT

The invention relates to an illumination device comprising a plurality of LEDs (3) arranged on a carrier, an optical element disposed in a path of light emitted by at least one of said LEDs (3), and a driving unit for operating at least one of said LEDs (3). The driving unit in a first operation mode drives at a selected power a first selection of LEDs (13, FIG. 3A) to issue a first beam with a device light flux and with a first beam width, and drives in an at least one further operation mode at said selected power a further selection of LEDs (13, FIG. 3B), different in at least one LED from said first selection, to issue a further beam with said device light flux and with a further beam width wider than the first beam width. The LEDs of the further selection of the LEDs are evenly distributed over the carrier.

15 Claims, 5 Drawing Sheets

(51) Int. Cl.
*F21Y 113/10* (2016.01)
*F21Y 115/10* (2016.01)

(56) References Cited

U.S. PATENT DOCUMENTS

| | | | | |
|---|---|---|---|---|
| 2013/0088142 | A1* | 4/2013 | Allen | F21K 9/62 313/498 |
| 2013/0208466 | A1 | 8/2013 | Huang et al. | |
| 2014/0084809 | A1* | 3/2014 | Catalano | H05B 45/10 315/295 |
| 2014/0321135 | A1 | 10/2014 | Chen et al. | |
| 2018/0172242 | A1 | 6/2018 | Stopa et al. | |

FOREIGN PATENT DOCUMENTS

| | | | |
|---|---|---|---|
| JP | 2013137913 | A | 7/2017 |
| WO | 2008152561 | A1 | 12/2008 |
| WO | 2011131197 | A1 | 10/2011 |
| WO | 2011132108 | A1 | 10/2011 |
| WO | 2014036509 | A1 | 3/2014 |

* cited by examiner

ILLUMINATION DEVICE, LIGHTING SYSTEM AND METHOD OF OPERATING THE ILLUMINATION DEVICE

CROSS-REFERENCE TO PRIOR APPLICATIONS

This application is the U.S. National Phase application under 35 U.S.C. § 371 of International Application No. PCT/EP2020/060650, filed on Apr. 16, 2020, which claim the benefit of European Patent Application No. 19170049.1, filed on Apr. 18, 2019. These applications are hereby incorporated by reference herein.

FIELD OF THE INVENTION

The present invention relates to adjustable illumination devices, such as light sources, and in more specifically to illumination devices with controllable beam width. Thereto, the illumination device comprises multiple individually controllable light-emitting diodes (LEDs). The present invention further relates to a method of operating said illumination devices and a lighting system comprising at least two of said illumination devices.

BACKGROUND OF THE INVENTION

For many applications, it is desirable to have a light source that produces a light beam whose angular distribution can be varied. Variability is needed, for example, to create a wide-angle light beam for illuminating an array of objects, or a narrow-angle beam for illuminating a single, small object. Conventionally, the angular distribution is varied by moving the light source(s), for example an LED arrangement, toward or away from the focal point of a lens or parabolic minor. As the light source is moved away from the focal point, its image is blurred, forming a wider beam. Unfortunately, in doing so, the image is degraded, becoming very non-uniform; in the case of the familiar parabolic reflector used in flashlights, a dark "donut hole" is formed, which is visually undesirable and sacrifices full illumination of the scene.

More recently illumination devices comprising an array of LEDs have become available in which the adjustable beam is obtained by activating or driving one or more subsets of LEDs, i.e. for a narrow beam or spot light a small number of centrally arranged LEDs are activated or driven, while for generating a wide beam or flood light either only a ring of less centrally arranged LEDs are activated/driven. However, in the case of the wide beam this has the disadvantage of the generation of the wide light beam having said dark "donut hole". Alternatively, to avoid said dark "donut hole" the ring of less centrally arranged LEDs and the centrally arranged LEDs are driven. However, these need to be driven at a dimmed level to avoid thermal overload of the illumination device and reach about the same light flux, rendering the illumination device to have the disadvantage of a relative high complexity and high costs.

SUMMARY OF THE INVENTION

It is an object of the invention to counteract at least one of the disadvantages of these known illumination devices. Thereto the illumination device of the type as described in the opening paragraph comprises:

a plurality of LEDs arranged on a carrier around a center thereof;

an optical element disposed in a path of light emitted by at least one of said LEDs and an optical axis extending through said center and said optical element; and a driving unit for operating at least one of said LEDs, the driving unit in a first operation mode is configured to drive at a first selected power P1 a first selection of LEDs L1 to issue a first beam with a first device light flux F1 and with a first beam width, and is configure to drive in an at least one further operation mode at a further selected power Pf a further selection of LEDs Lf, different in at least one LED from said first selection, to issue a further beam with a further device light flux Ff, with $0.5*F1<=Ff<=1.5*F1$, preferably with $0.8*F1<=Ff<=1.2*F1$, and with a further beam width wider than the first beam width, wherein the LEDs Lf of the further selection of the LEDs are evenly distributed over the carrier in that shortest distances between two closest LEDs of the LEDs Lf that are driven differ at the most by a factor three and wherein the first selection of LEDs has a first number N1 of LEDs and that the further selection of LEDs has a further number Nf of LEDs, wherein N1 is in the range of Nf±20%.

In this context the expression "evenly distributed" means that driven LEDs are selected from the plurality of LEDs so that a uniform wide beam is created in the far field, which can be attained, for example, by shortest heart-to-heart distances between two closest LEDS of the driven LEDs Lf, i.e. actively operating LEDs, hence ignited LEDs, differing at the most by a factor three. The expression "evenly distributed" can also described as that the ignited LEDs comprise outermost LEDs forming a perimeter of an area of active LEDs. Said perimeter surrounds a sub-area which is in size at least 70% of the total area occupied by all of the plurality of LEDs that are arranged on the carrier. Within said sub-area the feature of said shortest distances between two closest LEDs of the active LEDs is fulfilled. When the main direction of the light beam generated and issued by the illumination device is parallel to the optical axis, and the arrangement of LEDs on the carrier is divided into equal segments, then preferably the number of operating LEDs in the segments mutually differs at the most by 50%, preferably at the most by 20% for obtaining said evenly distribution of operating LEDs. Beyond 50% difference the light output and thermal load becomes substantially larger and hence extra demands on the working range of the driver begins to play a significant role, while if the difference is within +20% no serious demands are posed on the working range of the driver. For example, when the plurality of LEDs is arranged in a circle, each quadrant of the circle comprises about the same number, i.e. differs by the most of ±50% or +20% in number of operating LEDs.

The number of operating at least one of said LEDs can be, for example any number of LEDs in a range of two LEDs to ten-thousand LEDs, such as three, four, five, six, ten, sixteen, twenty-four, fifty, two hundred, or thousand LEDs.

An LED has a voltage drop which is essentially always the same and independent of the current flow through said LED. Hence, the typical method to drive simultaneously a multiple of LED's in the known illumination devices is by putting them in series, a string, and using a current source to drive and control the output of the string. These drivers have an operating window which is on the high side limited by a maximum voltage, a maximum current and in a maximum power, and on the low side by a minimum current and a minimum voltage. The voltage on the LED string depends on the number of LED's in series and the (constant) forward voltage of the LED. The output current of the driver is set to a value to generate the right amount of flux. Dimming is achieved by reducing the current through the LED string.

An example is given for an illumination device according to the prior art: Setpoint 1 is a narrow spot with only 12 LEDs of each 3V close to the center being operated at, a first power P1 for example 36 Volt, 1 A to generate of first light flux F1, yet with the possibility of dimming down to 10%, i.e. 0.1 A. Switching to a setpoint 2 of a broad beam will operate an increased number of LEDs, for example 52 LEDs, and thus increase the string length from 12 to 52 LEDs. Hence, the required voltage is 52*3V=156V. The current through said 52 LEDs must then be reduced to (12/52)*1 A=0.231 A to arrive at the same further power Pf with the further light flux Ff of the source being the same as the first light flux F1. If also in this case a dimming to 10% is needed the driver window must be very large in both the current and the voltage direction to support both modes. In particular a wide range in the voltage direction, as required for the known illumination devices, renders the driver for the known illumination devices to be relatively expensive and complex, which, moreover, has a negative impact on the performance of the driver and should preferably be avoided.

The plurality of LEDs as arranged on the carrier can be considered as a pixelated light source with individually controllable and/or composed groups of controllable LEDs. By these features a relatively simple illumination device is attained in which in a relatively simple manner switching between two types of beams is enabled with use of essentially the same number of operating LEDs. The two types of beams usually are, for example, a narrow beam or spot-light and a "filled" wide beam or a flood light, with the light flux maintains for both beams being substantially the same, i.e. with Ff being within a range of F1±50% or preferably +20%, without the need for dimming because of the risk of thermal overload. The selected power typically is determined by the selected amount of LEDs to be operated simultaneously and the selected current for operating said selected amount of LEDs. Hence, by the selection of power P1 and Pf it is determined how many LEDs will be driven simultaneously in both cases of a narrow beam and a broad beam and at which current. Typically the LEDs will be driven at nominal power and a dimming circuitry is not required, however, the possibility of dimming and the application of dimming circuitry in the present invention, typically via current control, is included in the invention. The plurality of LEDs may comprise individually controllable LEDs and/or separately controllable aggregated groups of LEDs. The first and further selections can thus be formed by selected said individually controllable LEDs and/or selected from separately controllable aggregated groups of LEDs.

The number of selections of driven LEDs is in the range of $$\binom{n}{k},$$

wherein n is typically in the range of 16 to 2500 and 2<=k<=n. Preferably, n is in the range of 30 to 1600, even more preferably in the range of 100 to 1000, while k preferably is in the range of 4 to 0.5*n, and more preferably in the range of 10 to 0.35*n, such as 20 to 0.25*n. A minimum number of LEDs and driven LEDs is preferred to have sufficient resolution, switching and fine-tuning possibilities of the beams to be generated, while a maximum number of LEDs and driven LEDs is preferred to render the illumination device to be relatively compact and simple and to obviate the risk of thermal overload.

Both the carrier and the optical element typically are arranged transverse to the optical axis, with the optical axis extending perpendicularly through the center of the carrier and through an optical element center. A variation in beam angle, i.e. the beam width, is typically obtained by difference in average distance between the driven LEDs. In particular, when a number of LEDs are driven which are relatively close to each other, a relatively small beam is obtained, while when the same number of LEDs are driven which are more remote from each other, a wider beam is obtained.

Similarly, a variation in beam direction is obtained by varying the average (rotational) position of a same number of driven LEDs from or around the center. Then, of course, the number of operating (i.e. switched on) LEDs in the segments, for example quadrants in the case of arrangement within a circle, may mutually differ significantly, for example more than 20%, for example all LEDs in a single quadrant may be switched on, while in the other three quadrants all LEDs may be switched off.

The Illumination device may have the feature that the optical element is a common, single lens having a lens axis coinciding with the optical axis. In such a configuration for the wide beam, beam angle typically is in a range of 30 to 75 degrees for full width at half maximum (FWHM), the driven LEDs are evenly spread over the carrier for the illumination device to issue a relatively filled wide beam. Yet, it might be possible to only drive LEDs adjacent to a perimeter of the carrier/single lens for the illumination device to issue a relatively hollow beam or batwing beam. For the illumination device to issue a relatively narrow beam, i.e. a beam angle typically is in range of 5 to 30 degrees FWHM, in such a configuration of the illumination device the driven LEDs typically are located adjacent to the center. Alternatively, the illumination device may have the feature that the optical element comprises a plurality of combinations of an LED and an individual, associated optical element with a respective orientation to the optical axis. In such an alternative configuration the LEDs to be driven for a desired beam profile depends on the optical property of the combination. This enables the possibility to optimize the arrangement of driven LEDs for issuing a narrow beam and wide beam for optimally counteracting a local thermal overload of the illumination device and/or rendering the illumination device to be as compact as possible.

It is further convenient that the illumination device has the feature that the first selection of LEDs L1 has a first number N1 of LEDs and that the further selection of LEDs Lf has a further number Nf of LEDs, wherein N1 is in the range of Nf±20% or N1 is in the range of Nf±10%, or N1 is the same as Nf. Alternatively or additionally, the illumination device may have the feature that each LED of the plurality of LEDs has essentially the same LED light flux when operated at the same current, hence same (nominal) power. Typically different colored LEDs have a (sometimes slightly) different voltage drop, hence by all the LEDs being selected from the same type of color, the voltage drop over each LED is the same. For example, assume that LEDs for the generation of the first light flux and the further light flux are all of the same type of white LEDs, thus all have the same voltage drop, when the first F1 and second light flux Ff might differ by 50%, preferably at the most by 20%, this means that the selected voltage difference between a first voltage V1 setting for the first flux F1 and a further voltage Vf setting for the further light flux Ff, might also differ by 50% respectively 20%, i.e. 0.5*V1<=Vf<=1.5*V1 respectively 0.8*V1<=Vf<=1.2*V1. The same goes for the range of the first number N1 of LEDs L1 and the range of the further number Nf of LEDs Lf, i.e. these ranges are mutually related according to 0.8*N1<=Nf<=1.2*N1. Thus an even more simpler illumination device is obtained for issuing a beam with the essentially same device light flux when switching between the first and further beams.

The illumination device may have the feature that at least one LED comprises a set of RGB LED dies. The dies preferably can be individually addressed and operated which enables the illumination device to provide color signals, for example a red signal in case of emergency. If all the LEDs of the plurality of LEDs comprise a respective set of RGB LED dies the illumination device is enabled to issue a versatile variety in colored beam patterns. The at least one LED additionally may comprise an amber and/or white LED die to increase the color pattern possibilities.

The illumination device might have the feature that the LEDs of the first and further selection are all different LEDs. This means that the driven LEDs of the first selection are different LEDs from the driven LEDs in the further selection. Thus it is counteracted in a simple manner that LEDs are driven in a mutually unbalanced way, i.e. that some LEDs are always driven while other LEDs are never driven.

The illumination device may have the feature that the LEDs of the first and further selection comprises a shared subset of the same LEDs. This has the advantage that providing a superfluous amount of LEDs is counteracted because the number of LEDs can be reduced.

The illumination device may have the feature that in operation in first and further operation mode activated LEDs all are operated at same current, resulting in operation at the same power, i.e. P1=Pf±50%, P1=Pf±20%, P1=Pf±10%, or P1=Pf, when the first selection of LEDs and the further selection of LEDs relate to the same type of LEDs and to approximately the same amount of simultaneously operating LEDs. This has the advantage that neither dimming nor boosting of LEDs is necessary to attain the set device light flux with the same number of driven LEDs. Thus a dimming circuitry is not required for the illumination device to have a constant light flux when switching between a narrow beam and a wide beam, thus enabling embodiments of the illumination device to be relatively simple and cheap.

The illumination device may have the feature that the LEDs of the plurality of LEDs are arranged in a matrix, said matrix may comprise empty cells. In the case only a limited number of settings are needed for operation of the illumination device the number of selections and hence the number of addressable LEDs can be reduced and some positions in the matrix arrangement are not necessary. To render the illumination device still cheaper, LEDs can be omitted in the positions that are not used.

The illumination device may have the feature that during operation a high switching frequency, i.e. typically in the range of 100 Hz to 100 MHz, of different but a same amount of activated LEDs is imposed by the driver. Thus it is attained that a local thermal load is counteracted due to some LEDs not being constantly driven and further that a smoothened, relatively uniform beam can be obtained, in particular when the switching frequency is at least 1000 Hz. Alternatively, as a relatively cheap and simple solution for smoothen the first and further beam, the optical element can be slightly diffusing, for example frosted, sand-blasted, or provided with a satinized coating/sticker.

The invention further relates to a lighting system comprising at least two illumination devices according to invention and a control unit for controlling the at least two illumination devices. The control unit may be connected to the illumination devices via wiring or wirelessly. Typically a user interface, such as a smart phone or a remote control is comprised in such a lighting system. In particular the control unit can create static or dynamic lighting scenes made by controlled cooperation of a plurality of illumination devices. Such a system is relatively cheap and still provides ample possibilities in providing various lighting scenes. The lighting system, of course, may comprise more than two illumination devices, for example at least three, five, ten, thirty or up to two hundred and fifty illumination devices or even more.

The invention still further relates to a method of operating an illumination device according to the invention, the method comprising the steps of.

- driving a first selection of LEDs L1 at a selected first operation power P1 for issuing a first beam with a first beam width and generating a first device light flux F1;
- simultaneously switching off the first selection of LEDs and activating a further selection of LEDs Lf at a further selected operation power Pf for issuing a further beam generating a further device light flux Ff and with a further beam width different from the first beam width.

The method optionally may comprise additional steps like the possibility to select a repetition of these steps to create an illumination cycle program and/or to choose the illumination device to operate at a dimming level. Equally the method is applicable on a lighting system according to the invention in which a plurality of illumination devices is controlled.

BRIEF DESCRIPTION OF THE DRAWINGS

The invention will now be further elucidated by means of the schematic drawings, which are by no means intended to limit the scope of the invention but rather serve as illustration for the ample range of possibilities of the invention. In the drawings

DETAILED DESCRIPTION OF THE EMBODIMENTS

Figure 1A:
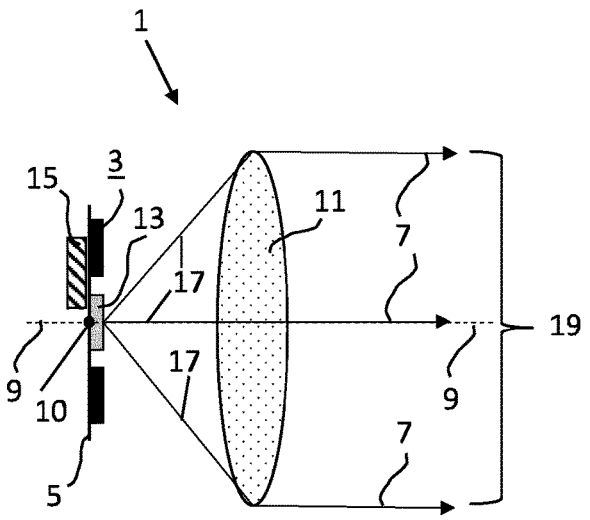
FIGS. 1A-B show the principle of an illumination device providing an adaptable spot.
Figure 1B:
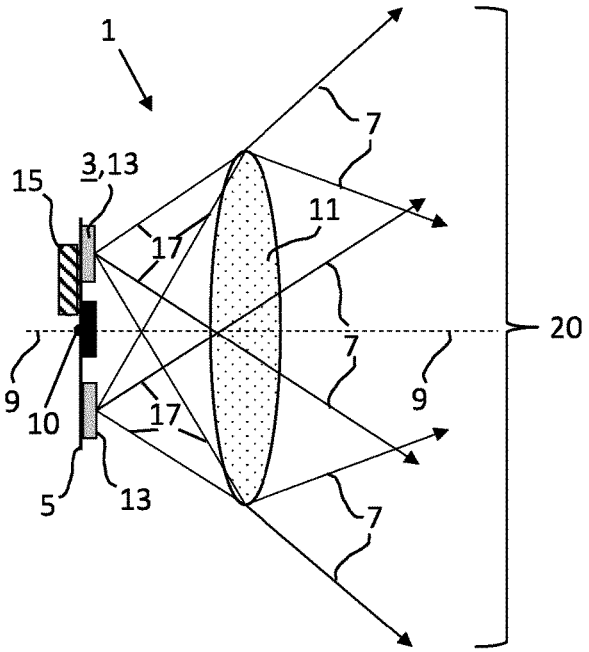

FIGS. 1A-B show an illumination device 1 and the principle of operation of an illumination device with a pixelated light source providing an adaptable spot. The illumination device comprises as the pixelated light source a plurality of LEDs 3 arranged as an LED array on a carrier 5. The LEDs issue light over a path of light along 7 an optical axis 9 towards an optical element 11, in the figure a single lens positioned downstream from the LED array. The optical axis 9 extends through a center 10 of the carrier and through the transversely arranged optical element. In FIG. 1A only one LED 13 positioned on the optical axis in the center of the carrier is driven (i.e. is in operation to produce light) by driver 15. Light rays 17 issued by the LED towards the optical element are redirected via refraction to form a narrow beam 19 of device light. In FIG. 1B only two LEDs 13 positioned remote from the optical axis close to perimeter/edge of carrier are driven by driver 15. Light rays 17 issued by the LED towards the optical element are redirected via refraction to form a wide beam 20 of device light.

Figure 2:
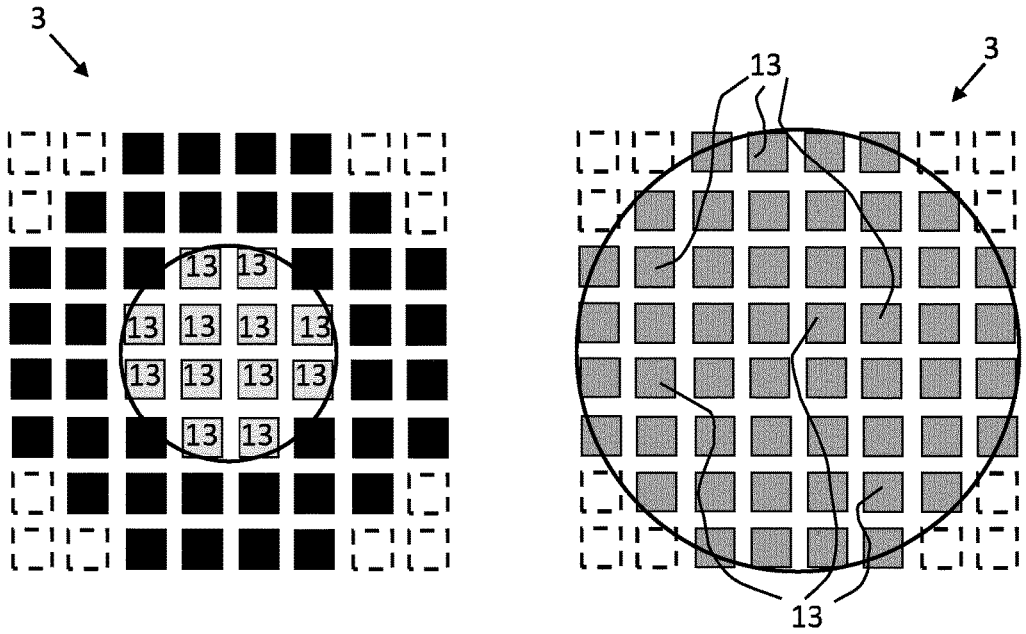
FIG. 2 (PRIOR ART)
FIG. 2 shows top views of operation modes of a plurality of LEDs arranged in an array in an illumination device according to the prior art providing an adaptable spot.

FIG. 2 shows top views of a plurality of LEDs 3 arranged in a matrix array. The plurality of LEDs functions as a pixelated light source. The figure further shows two operation modes of the pixelated light source of an illumination device according to the prior art. In the operation mode shown on the left in the figure, twelve only relatively centrally located LEDs 13 are driven at a relatively high current at hence at a relatively high power and provide a relatively narrow beam of relatively high intensity with a device light flux, while the other LEDs are switched off. In the operation mode shown on the right in the figure, essentially all LEDs 13 of the plurality of LEDs 3 are driven in a dimmed state, i.e. the prior art illumination device requiring a dimming circuitry to enable to operate the LEDs at a low current and hence at a relatively low power, and provide a relatively wide beam of a relatively low intensity, but with the same device light flux. Thus an adaptable spot with the same device light flux is obtained according to the prior art.

Figure 3A:
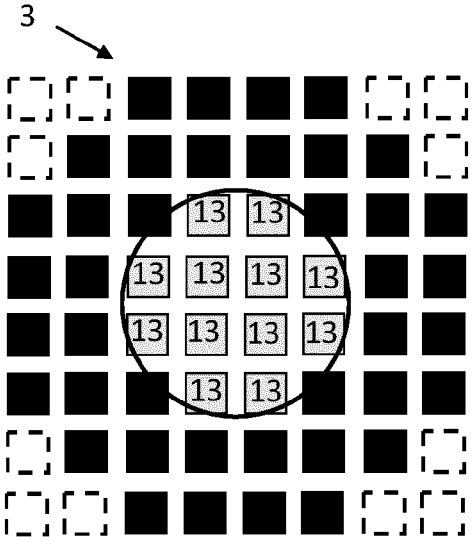
FIGS. 3A-B show top views of operation modes of a plurality of LEDs arranged in an array in a first embodiment of an illumination device according to the invention providing an adaptable spot.
Figure 3B:
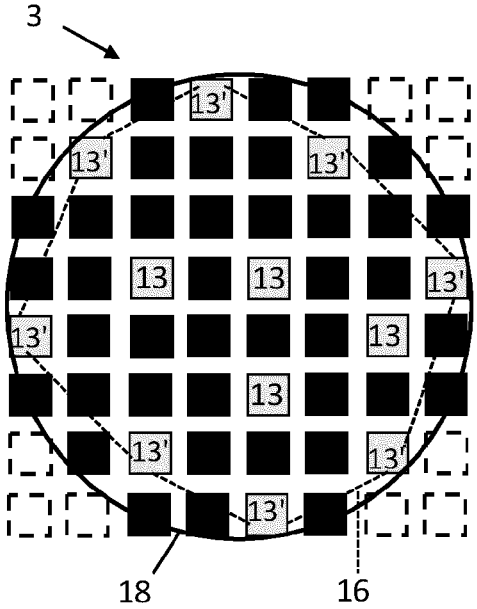

FIGS. 3A-B show top views of a plurality of LEDs 3, all having the same light output when operated at the same nominal power, arranged in a matrix array in the same arrangement as shown for the prior art illumination device shown in FIG. 2. The plurality of LEDs functions as a pixelated light source. The FIGS. 3A-B further shows two operation modes of the pixelated light source of a first embodiment of an illumination device according to the invention for providing an adaptable spot. In the operation mode shown in FIG. 3A, a first selection L1 21 of only twelve, relatively centrally located LEDs 13 are driven at nominal power and provide a relatively narrow beam of relatively high intensity with a device light flux F1. In the operation mode shown in FIG. 3B, a further selection Lf 23 of also only twelve LEDs 13 of the plurality of LEDs 3 are driven at nominal power. However, compared to the twelve driven LEDs of the first selection, the twelve driven LED of the further selection are at a mutually increased distance and are in more spread/distributed positions, in a rather evenly manner, on the LED array. This results in a relatively wide beam of a relatively low intensity but with the same device light flux, i.e. Ff=F1, as issued by the illumination device of FIG. 3A. Thus an adaptable spot with the same device light flux is obtained according to the invention. For the light beam as issued form the illumination device to appear uniform in the far field, in the embodiment shown in FIGS. 3A-B, the optical element is preferably slightly diffusing/scattering. The diffusive property of the optical element can, for example, be obtained by etching, sand-blasting at least one of the main surfaces of the optical element, or provide at least one of said main surfaces with a diffusing coating/sticker. In FIG. 3B it is further shown that the ignited LEDs 13 comprise outermost LEDs 13' forming a perimeter 16 of an area of active LEDs. Said perimeter surrounds a sub-area which is in size about 80% of the total area occupied by all of the plurality of LEDs that are arranged on the carrier, said total area is indicated by circle 18. Within said sub-area the feature of said shortest distances between two closest LEDs of the active LEDs differing at the most by a factor three, is fulfilled.

Figure 4A:
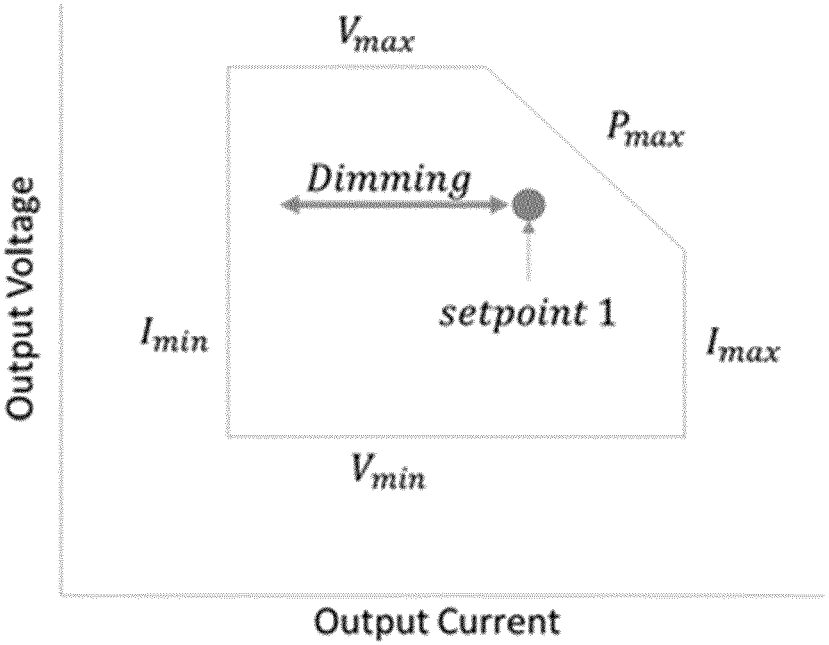
FIG. 4A-B show driver operation windows according to prior art and according to the invention.
Figure 4B:
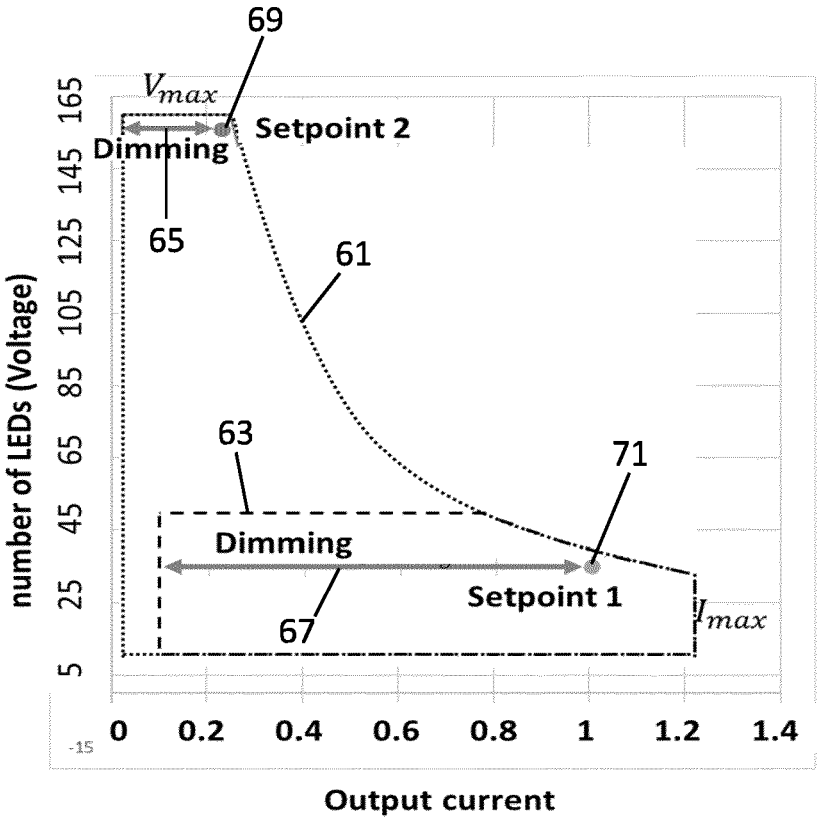

FIG. 4A-B show driver operation windows according to prior art 61 and according to the invention 63. A typical method to drive a multiple LED's is by putting them in series and using a current source to drive the string. FIG. 4A shows the principle by which the boundaries of the operating window of drivers are obtained. Typically these drivers have an operating window which is on the high side limited by a maximum voltage Vmax, a maximum current Imax, and in a maximum power Pmax. On the low side the operating window has a minimum current Imin and a minimum voltage Vmin. The voltage on the LED string depends on the number of LED's in series and the forward voltage of the LED. The output current of the driver is set to a value to generate the right amount of flux. Setpoint 1 and Setpoint 2 indicate setpoints 69, 71 for about a maximum flux. Dimming is achieved by reducing the current through the LED string and is indicated by dimming arrows 65, 67. In FIG. 4B one can see the two modes of operation (narrow beam wide beam) of the known illumination device a shown in FIG. 2, plotted in one figure. "Setpoint 1" 71 is plotted at 36 Volt, 1 A for operating only twelve LEDs for obtaining the narrow spot, and a dimming range down to 0.1 A indicated by arrow 67. When switching to "Setpoint 2" 69 the string length increases from 12 to 52 operating LED's so the required voltage is 156V, hence the current should be 0.231 A to arrive at the same output flux of the known illumination device. If also in this case a dimming to 10% is needed, the current should be reduced to 0.0231 A. Hence, as shown, the driver window 61 for the known illumination devices, as indicated by the fine dotted line, must be very large in both the current and the voltage direction to support both operation modes. Contrary to the relatively large operation window required for the prior art illumination devices, the invention keeps the two modes inside the relatively small driver window 63 for the inventive illumination devices, indicated by the coarse dotted line, by using (more or less) equal amounts of LED's in both modes.

Figure 5A:
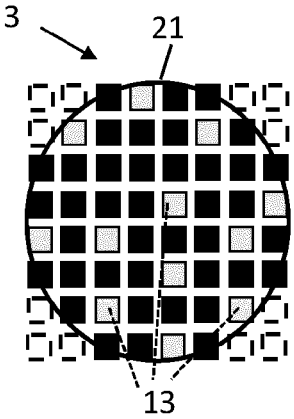
FIGS. 5A-D show operation modes of a second embodiment illumination device according to the invention providing an adaptable spot.
Figure 5B:
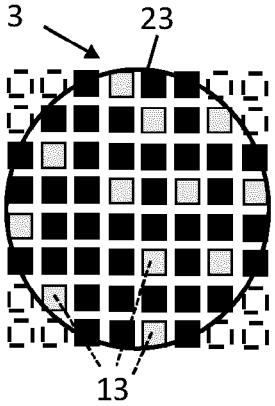
Figure 5C:
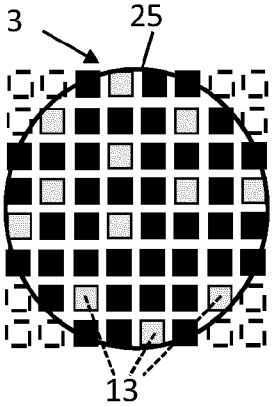
Figure 5D:
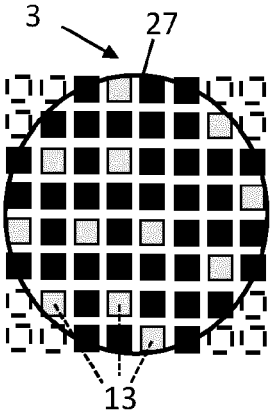

FIGS. 5A-D show operation modes of a second embodiment of an illumination device according to the invention providing an adaptable spot. In these FIGS. 5A-D four operation modes are shown which all result in the illumination device to issue practically the same wide light beam with the same intensity and the same device light flux. In FIG. 5A a first selection 21 of twelve driven LEDs 13 is made to generate the light beam, while in FIGS. 5B-C respectively a second selection 23, a third selection 25 and a fourth selection 27, all as further selections, of twelve driven LEDs are made to generate essentially the same light beam. In the FIGS. 5A-D only four different selections are shown. However, it is evident that a much larger number of selection of LEDs from the plurality/array of LEDs 3 is possible to create a wide variety of possible beams. In particular in the illumination device shown in FIG. 5A-D the number of possible selections in principle are:

$$\binom{n}{k},$$

wherein n=52 and k=12, resulting in n!/((n!−k!)*k!)≈2*10^11 possible selections. By a high frequency change, for example at a frequency of 10,000 Hz or 1 MHz, in the selection of wider spread LEDs in the source such that more LEDs are contributing to the beam profile and less smoothing is needed from the optical element.

Figure 6:
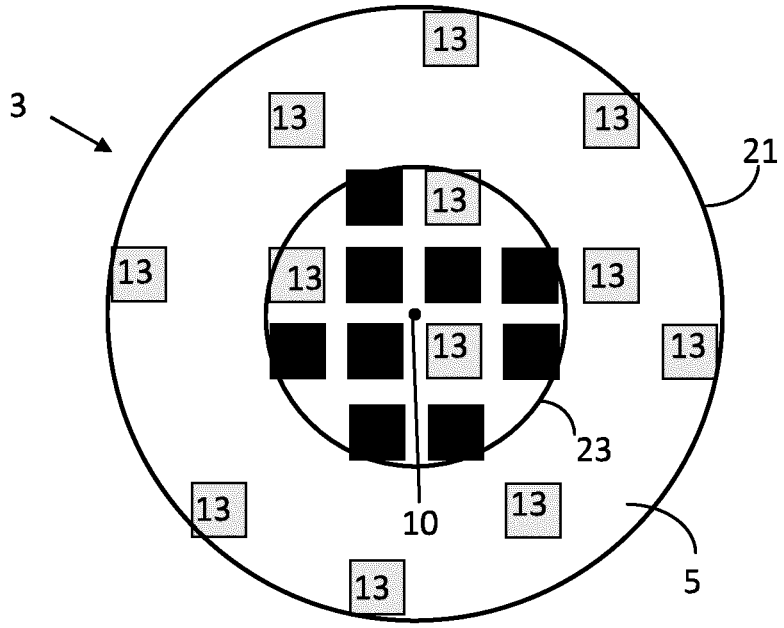
FIG. 6 shows an LED array of a third embodiment illumination device according to the invention providing an adaptable spot.

FIG. 6 shows a top view of a plurality of LEDs 3 according to a third embodiment of an illumination device according to the invention providing an adaptable spot. In this embodiment the plurality of LEDs is arranged in a matrix, cell arrangement wherein quite a large number of cells are empty, i.e. LEDs are removed or never provided in these empty cells. Such an embodiment of the illumination device is interesting and feasible in the case the illumination device is used in only a (very) limited number of settings. As shown in the FIG. 6, the illumination device is designed to switch between two settings, i.e. the setting shown, which is a single type of wide beam as generated by a first selection 21 of evenly spread driven LEDs 13, and in the alternative narrow beam setting to be generated by a selection 23 of inactive/non-driven LEDs arranged relatively centrally around center 10 of the carrier 5. In the embodiments shown there is an overlap of three out of the twelve LEDs that are part of both the first and the second selection.

Figure 7:
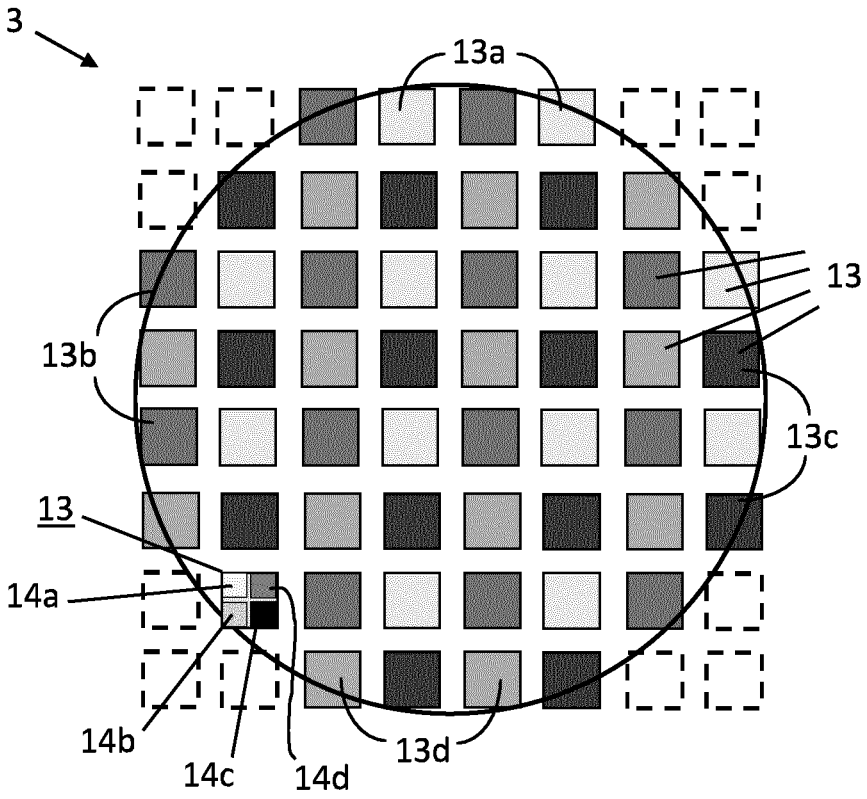
FIG. 7 shows an LED array of a fourth embodiment illumination device according to the invention providing an adaptable spot.

FIG. 7 shows a plurality of LEDs 3 arranged in an LED array of a fourth embodiment of an illumination device according to the invention providing a color adaptable spot. The fourth embodiment shown has four different colored LEDs 13, i.e. red LEDs 13*a*, green LEDs 13*b*, blue LEDs 13*c* and amber LEDs 13*d*. The plurality of LEDs comprises either a mixture of single colored LEDs of different color, for example single colored red, green, blue, and optionally amber and white LEDs, in a well-mixed arrangement, or the plurality of LEDs comprises at least one single LED, but preferably all LEDs, having differently colored LED dies, for example red 14*a*, green 14*b*, blue 14*c*, amber dies 14*d*, which is indicated in the figure for one LED. Well-mixed means that LEDs of a specific color has neighboring LEDs of only different colors, for example in an arrangement as shown in the FIG. 6. The dies and/or LEDs can be individually addressed and operated which enables the illumination device to provide color signals, for example a red signal in case of emergency or to issue a versatile variety in colored beam patterns.

Figure 8:
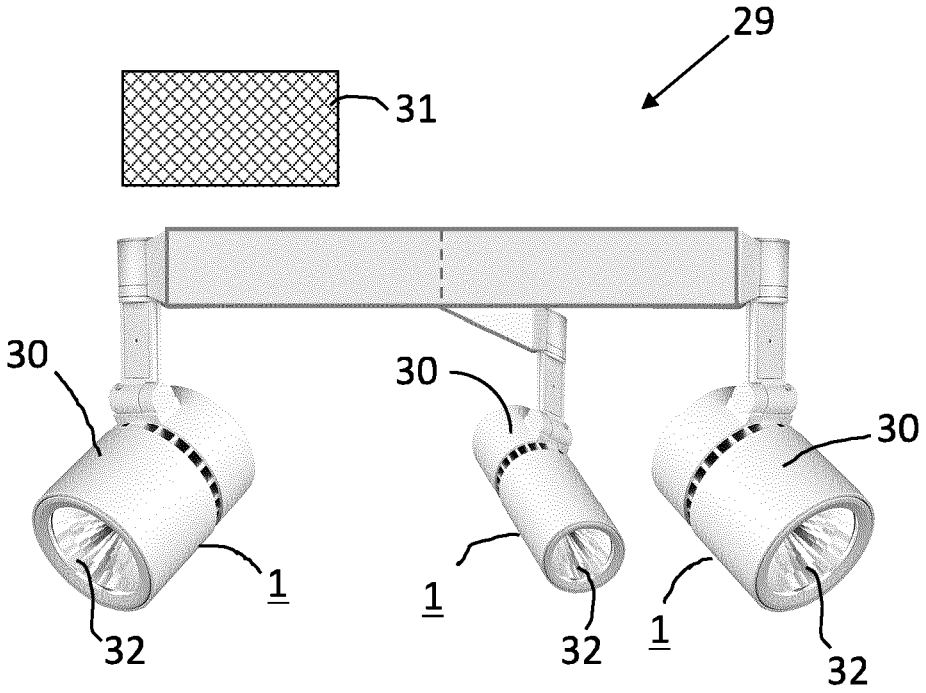
FIG. 8 shows an embodiment of a system according to the invention.

FIG. 8 shows a lighting system 29 according to the invention comprising three illumination devices 1 according to the invention and a control unit 31 connected to the illumination devices. Each illumination device comprises a respective housing 30 accommodating a respective plurality of LEDs (not shown), a driver (not shown), a reflector 32 and a lens (not shown). The control unit can actualize a controlled cooperation of a plurality of illumination devices to create a static lighting setting or to create dynamic lighting scenes. Thereto the control unit can activate anyone of the illumination devices individually, which can result in that the illumination devices can operate solely, sequentially or simultaneously, dependent on what light setting or lighting scene is desired.

Figure 9:
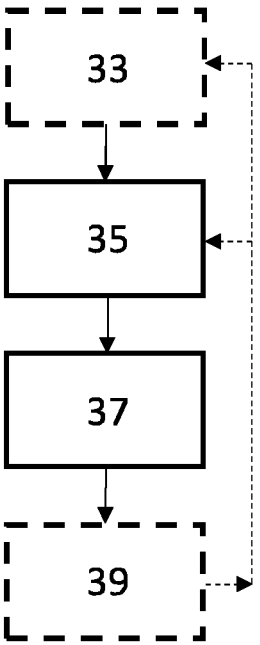
FIG. 9 shows a method according to the invention.

FIG. 9 shows a method according to the invention. The method shown comprises four steps, i.e.:

First step 33 setting the dimming level of the illumination devices, please note that this step is optional;

Second step 35: driving a first selection of LEDs at a selected operation power for issuing a first beam with a first beam width and generating a device light flux;

Third step 37: simultaneously switching off the first selection of LEDs and activating a further selection of LEDs at said selected operation power for issuing a further beam generating said device light flux and with a further beam width different from the first beam width; and Fourth step 39: select a repetition of these steps to create an illumination cycle program either to repeat from the first step or from the second step, please note that this is an optional step.

The invention claimed is:

1. An illumination device comprising:

a plurality of LEDs arranged on a carrier around a center thereof;

an optical element disposed in a path of light emitted by at least one of said LEDs, an optical axis extending through said center and said optical element; and a driving unit for operating at least one of said LEDs, the driving unit in a first operation mode is configured to drive at a selected power P1 a first selection of LEDs L1 to issue a first beam with a first device light flux F1 and with a first beam width, and is configured to drive in an at least one further operation mode at a further selected power Pf a further selection of LEDs Lf, different in at least one LED from said first selection, to issue a further beam with a further device light flux, with 0.5*F1<=Ff<=1.5*F1, preferably with 0.8*F1<=Ff<=1.2*F1, and with a further beam width wider than the first beam width, wherein the LEDs Lf of the further selection of the LEDs are evenly distributed over the carrier in that shortest distances between each two neighboring LEDs of the LEDs Lf that are driven differ at the most by a factor three and wherein the first selection of LEDs has a first number N1 of LEDs and that the further selection of LEDs has a further number Nf of LEDs, wherein N1 is in the range of Nf±20%.

2. Illumination device as claimed in claim 1, characterized in that the LEDs arranged on the carrier numbers n and the LEDs to be operated simultaneously numbers k, wherein n is in the range of 30-2500 and k in in the range of 10<=k<=0.35*n.

3. Illumination device as claimed in claim 1, characterized in that each LED of the plurality of LEDs has essentially the same LED light flux when operated at the same (nominal) power.

4. Illumination device as claimed in claim 1, characterized in that at least one LED comprises a set of RGB LED dies.

5. Illumination devices as claimed in claim 1, characterized in that the optical element is a common, single lens having a lens axis coinciding with the optical axis.

6. Illumination devices as claimed in claim 1, characterized in that the LEDs of the first and further selection are all different LEDs.

7. Illumination devices as claimed in claim 1, characterized in that the LEDs of the first and further selection comprises as a shared subset of the same LEDs.

8. Illumination devices as claimed in claim 1, characterized in that in operation in first and further operation mode activated LEDs all are operated at same current.

9. Illumination devices as claimed in claim 1, characterized in that at least LEDs located adjacent to the center are activated for the illumination device to issue a relatively narrow beam.

10. Illumination device as claimed in claim 1, characterized in that the LEDs of the plurality of LEDs are arranged in a matrix, said matrix may comprise empty cells.

11. Illumination device as claimed in claim 1, characterized in that during operation a high frequency switching (100 Hz-100 MHz) of different but a same amount of activated LEDs is imposed by the driver.

12. Illumination device as claimed in claim 1, characterized in that the optical element can be slightly diffusing for smoothen the issued first and further beam.

13. A lighting system comprising at least two illumination devices according to claim 1, and a control unit for controlling the at least two illumination devices.

14. Method of operating an illumination device according to claim 1, the method comprising the steps of:

driving a first selection of LEDs L1 at a selected first operation power P1 for issuing a first beam with a first beam width and generating a first device light flux F1;

simultaneously switching off the first selection of LEDs and activating a further selection of LEDs Lf at a further selected operation power Pf for issuing a further beam generating a further device light flux Ff and with a further beam width different from the first beam width.

15. Method of operating an illumination device according to claim 14, the method comprising the further steps of:

setting the dimming level of the illumination devices; and select a repetition of these steps to create an illumination cycle program.

* * * * *